United States Patent [19]

Rolle et al.

[11] Patent Number: 4,892,261

[45] Date of Patent: Jan. 9, 1990

[54] MATERIAL COMMUNITOR

[75] Inventors: Thomas E. Rolle; David J. Nebel; John L. Shulan; William P. Liljestrom, all of Dubuque, Iowa

[73] Assignee: The T.D.J. Co., Inc., Dubuque, Iowa

[21] Appl. No.: 341,793

[22] Filed: Apr. 21, 1989

Related U.S. Application Data

[63] Continuation of Ser. No. 112,408, Dec. 7, 1987, which is a continuation of Ser. No. 841,795, Mar. 20, 1986, Pat. No. 4,718,609.

[51] Int. Cl.[4] ..... B02C 19/18

[52] U.S. Cl. ..... 241/301; 241/1

[58] Field of Search ..... 241/1, 301, 5, 39, 15, 241/285 R, 285 A, 285 B, 47; 415/121 R, 121 B, 204

[56] References Cited

U.S. PATENT DOCUMENTS

| | | |
|---|---|---|
| 1,578,609 | 3/1926 | Mason . |
| 2,280,619 | 4/1942 | Berry . |
| 2,515,542 | 7/1950 | Yellott . |
| 2,636,688 | 4/1953 | Singh . |
| 2,668,669 | 2/1954 | Skelly . |
| 3,255,793 | 6/1966 | Clute . |
| 3,352,498 | 11/1967 | Schulte . |
| 3,545,683 | 12/1970 | Schulte . |
| 3,881,660 | 5/1975 | Ribas . |
| 3,973,733 | 8/1976 | Switzer . |
| 4,390,131 | 6/1983 | Pickrel . |
| 4,391,411 | 7/1983 | Colburn . |

*Primary Examiner*—Mark Rosenbaum

*Attorney, Agent, or Firm*—Hill, Van Santen, Steadman & Simpson

[57] ABSTRACT

A comminution device is provided which has a rotatable turbine mounted in a housing for causing an air flow through an expansion chamber. Material to be comminuted is carried in an air stream through the expansion chamber where it is rapidly decompressed causing it to explode. The turbine is made of a plurality of air foil blades mounted on a backing plate and is dimensioned in close tolerance to its housing. Exchangeable expansion chambers are provided to vary the rate of pressure reduction which effects the size of the communited material. The shaft of the turbine is mounted in oil cooled bearings to increase the life and efficiency of the bearings and turbine blades.

2 Claims, 4 Drawing Sheets

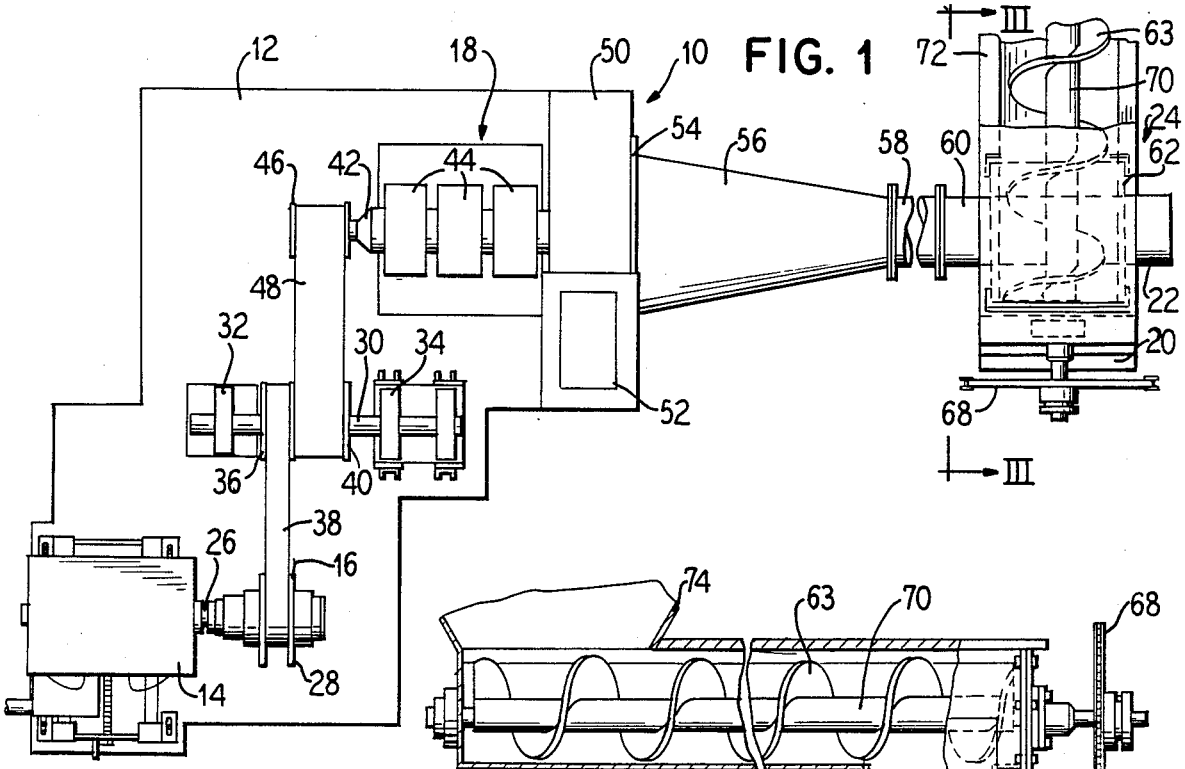
FIG. 1
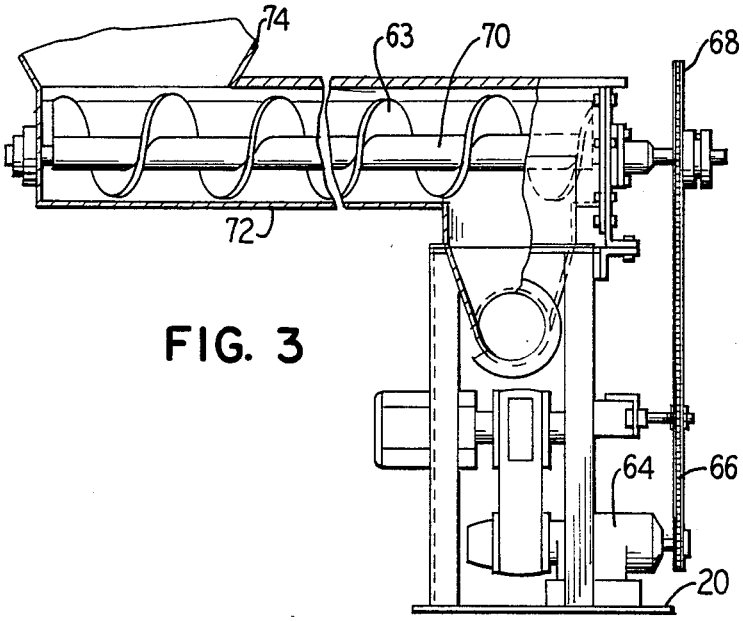
FIG. 3
FIG. 2
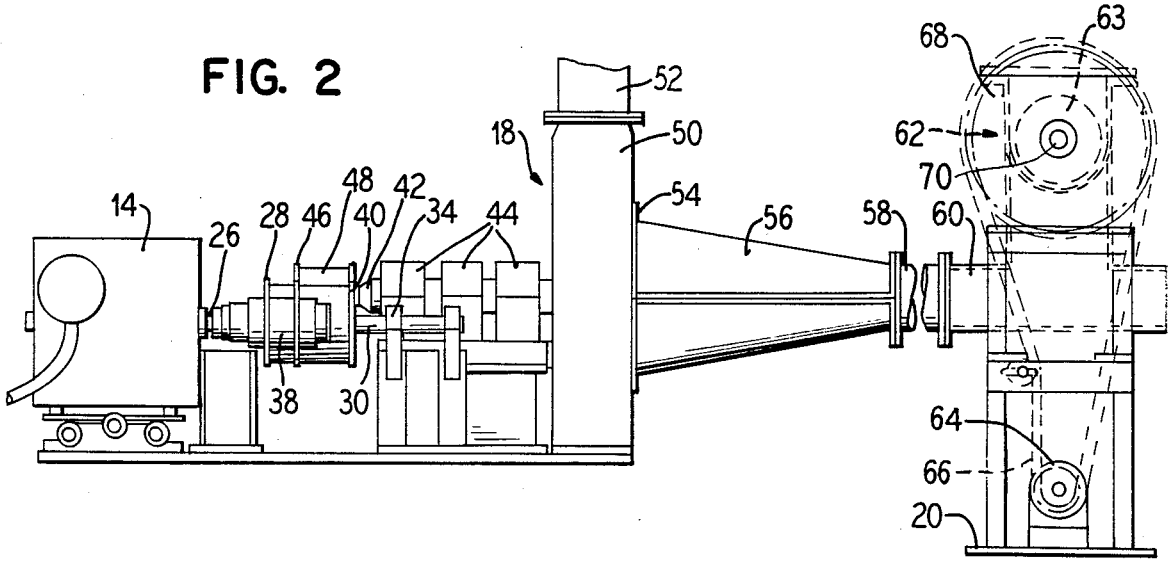

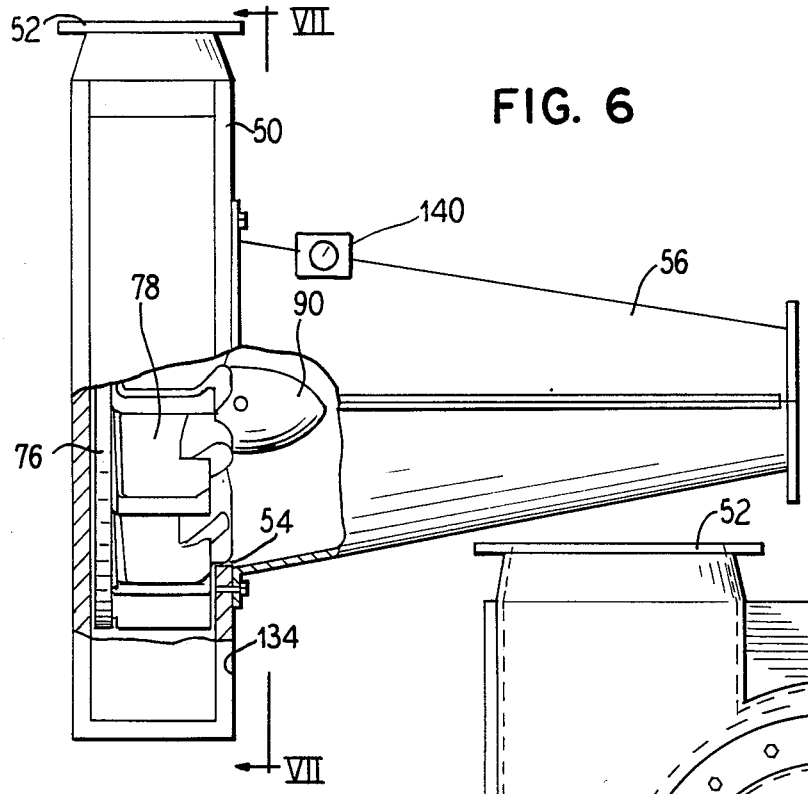
FIG. 6
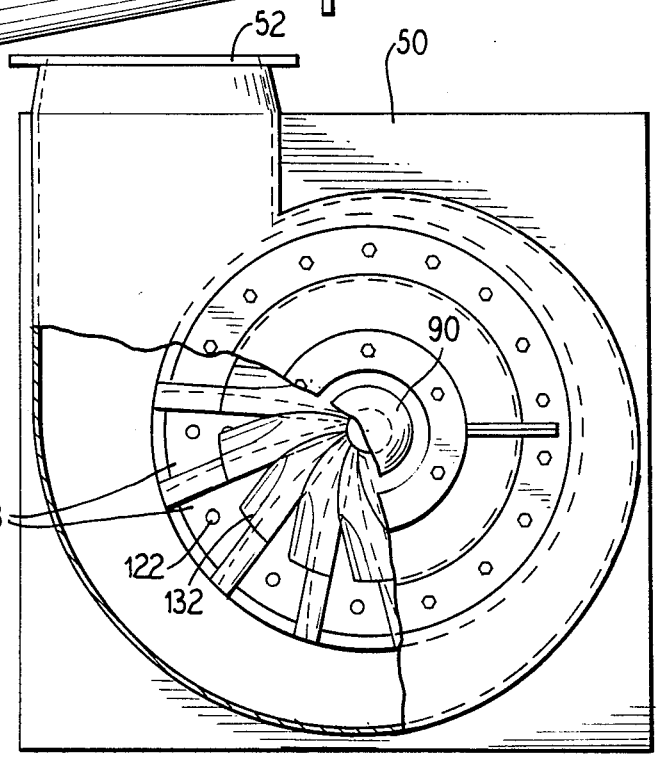
FIG. 7
FIG. 8
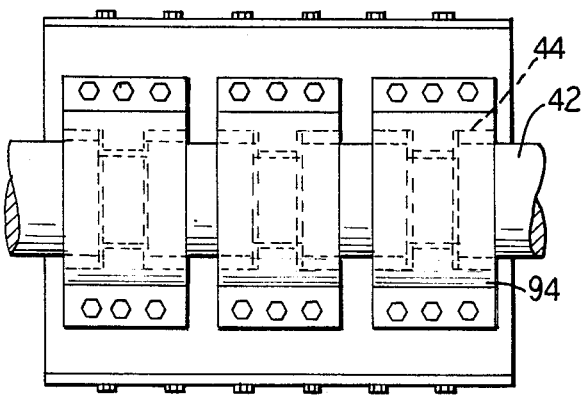
FIG. 9
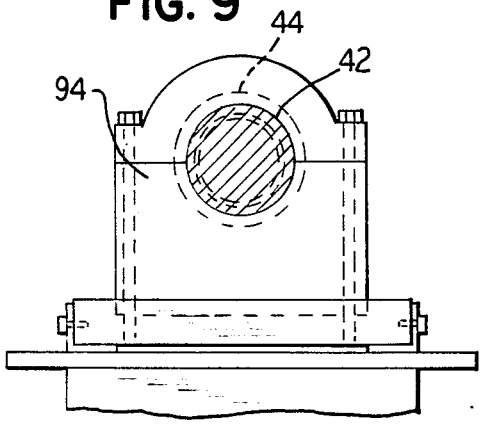

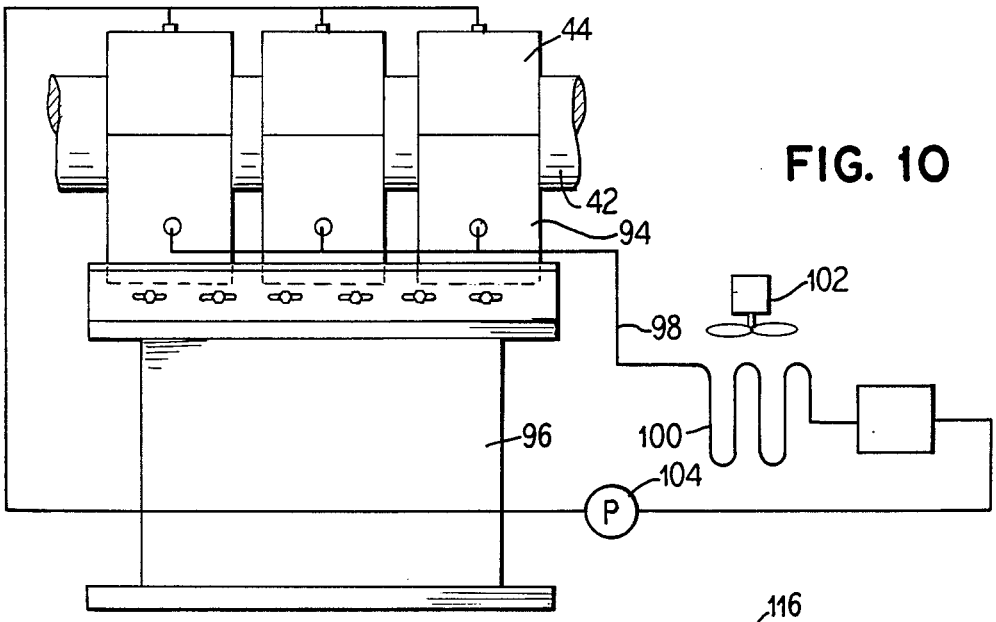
FIG. 10
FIG. 12
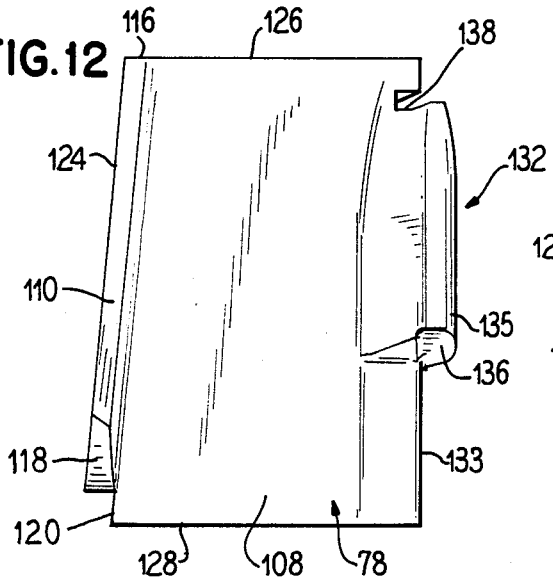
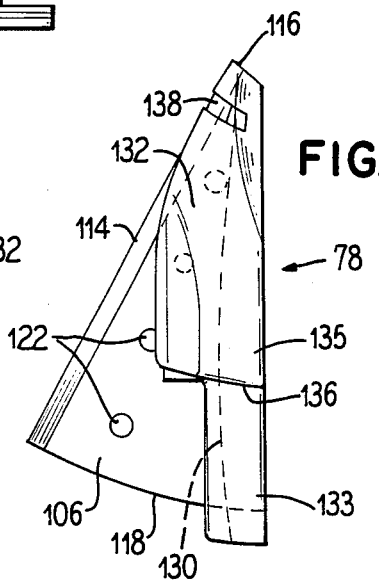
FIG. 13
FIG. 11
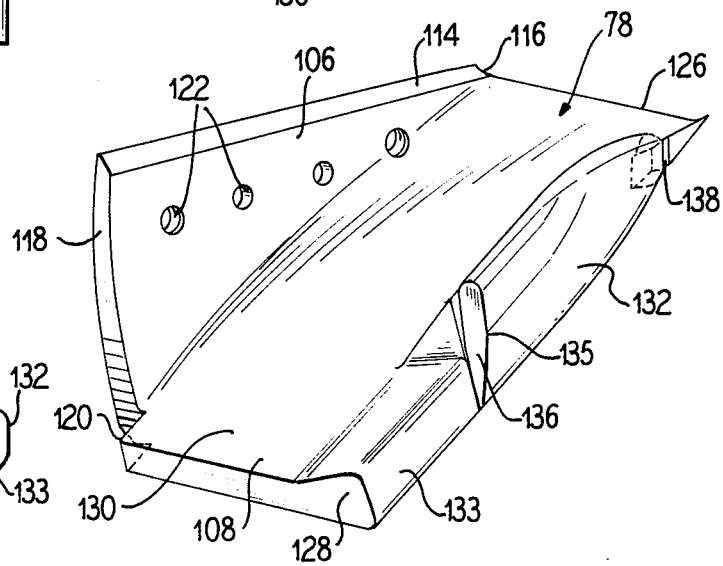
FIG. 14
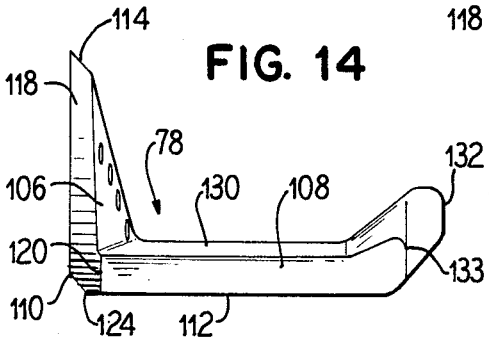

MATERIAL COMMUNITOR

This is a continuation of application Ser. No. 112,408, filed Dec. 7, 1987, which in turn is a continuation of application Ser. No. 841,795, filed Mar. 20, 1986, now U.S. Pat. No. 4,718,609.

BACKGROUND OF THE INVENTION

1. Field of the Invention

The present invention relates to devices for comminuting solid materials through a rapid reduction in pressure surrounding the materials, and more particularly, to a device using a rotating blade to effect the pressure reduction.

2. Description of the Prior Art

A device for comminuting solid particles is disclosed in U.S. Pat. No. 3,255,793 to Clute. The device disclosed in that patent provides a rotatable fan having blades 80 tangentially extending from a hub 70 which is attached to a front end of a cantilevered shaft 48. A housing just preceeding the fan is constructed to be enlarged directly adjacent to the fan to cause a reduction of pressure in the housing adjacent the fan to effect the explosive comminution of the particles.

The fan shaft 48 is carried in bearings 42 and 44, both of which are outside of the housing and spaced behind the fan. The fan blades are formed as a cast assembly and are shaped in a concave lateral cross-section to act as elongated cups to push air through the housing. Thus, the windage effect on the fan blades is quite high.

A comminution device is also disclosed in U.S. Pat. No. 4,390,131 to Pickrel which, does not use a rotating fan, but rather uses a plurality of tangentially introduced air flows. However, the text of the patent does discuss the patent to Clute and states that the vanes of the blower rotor, being subject to comminuted material, wear rapidly, particularly at the tips and the leading edges, causing great expense in replacement of the blades. Also, the wear of the blades tends to be uneven so that undue vibration often requires the rotor to be replaced before any vanes are worn out.

The patent to Pickrel also discusses the use of a comminutor having a fan with inclined blades rather than the trough-like section of Clute, but otherwise corresponding thereto, of a particular size and dimension which was fed with gold ore at the rate of one ton per hour and the fan required replacement at the end of one hundred hours of operation. It was also suggested that since the fan shaft was over hanging (cantilevered), the bearings for the shaft also became unduly worn.

Another patent disclosing a comminution device is No. 4,391,411 to Colburn who again discusses the patent to Clute and suggests a means of improving on that concept by attaching essentially two substantially similar comminution devices in a serial arrangement to effect two comminution events, one after the other, and requiring only a single dust collecting apparatus. Colburn also suggests that the first inlet should be vertical so that the material may be admitted in a gravity assisted manner to reduce the energy required to accelerate the particles toward the first rotating fan.

SUMMARY OF THE INVENTION

The present invention provides for an improvement over the prior art devices, particularly the device disclosed and patented by Clute in a number of areas, which include a means for varying the speed of the fan to effect a difference in the size of the comminuted materials, a separate means for effecting a change in the size of the materials comprising a replaceable housing upstream of the fan to vary the rate of pressure reduction experienced by materials passing through the housing with variously configured housings, a means for cooling the bearings that the fan shaft is journaled in to provide an increased life for the bearing shaft and to reduce wear, a means for reducing the temperature of the turbine fan blade members to increase the life of those members, an improved configuration for the turbine blades to increase the efficiency of air flow through the device and to reduce the effect of the material passing through the device on the turbine blades, an improvement in the construction of the housing to increase the efficiency of the device, inclusion of a pressure sensing device to permit the control of the speed of the turbine blades to effect proper sizing of the comminuted material, and other improvements which are set forth in more detail in the accompanying specification.

BRIEF DESCRIPTION OF THE DRAWINGS

FIG. 1 is a plan view of the device incorporating the principles of the present invention.

FIG. 2 is a side elevational view of the device shown in FIG. 1.

FIG. 3 is a sectional view partially cut away taken generally along the lines III—III of FIG. 1.

FIG. 6 is a side elevational view, partially cut away, of the comminuting portion of the device.

FIG. 7 is a front elevational view, partially broken away, taken generally along the lines VII—VII of FIG. 6.

FIG. 8 is a plan view of the bearing housing for the turbine shaft.

FIG. 9 is an end view of the bearing housing of FIG. 8.

FIG. 10 is a schematic illustration of the oil cooling circuit of the present invention.

FIG. 11 is a perspective view of a turbine fan blade.

FIG. 12 is a side elevational view of a turbine fan blade.

FIG. 13 is a top elevational view of the turbine fan blade.

FIG. 14 is an end elevational view of the turbine fan blade.

DESCRIPTION OF THE PREFERRED EMBODIMENTS

Figure 4:
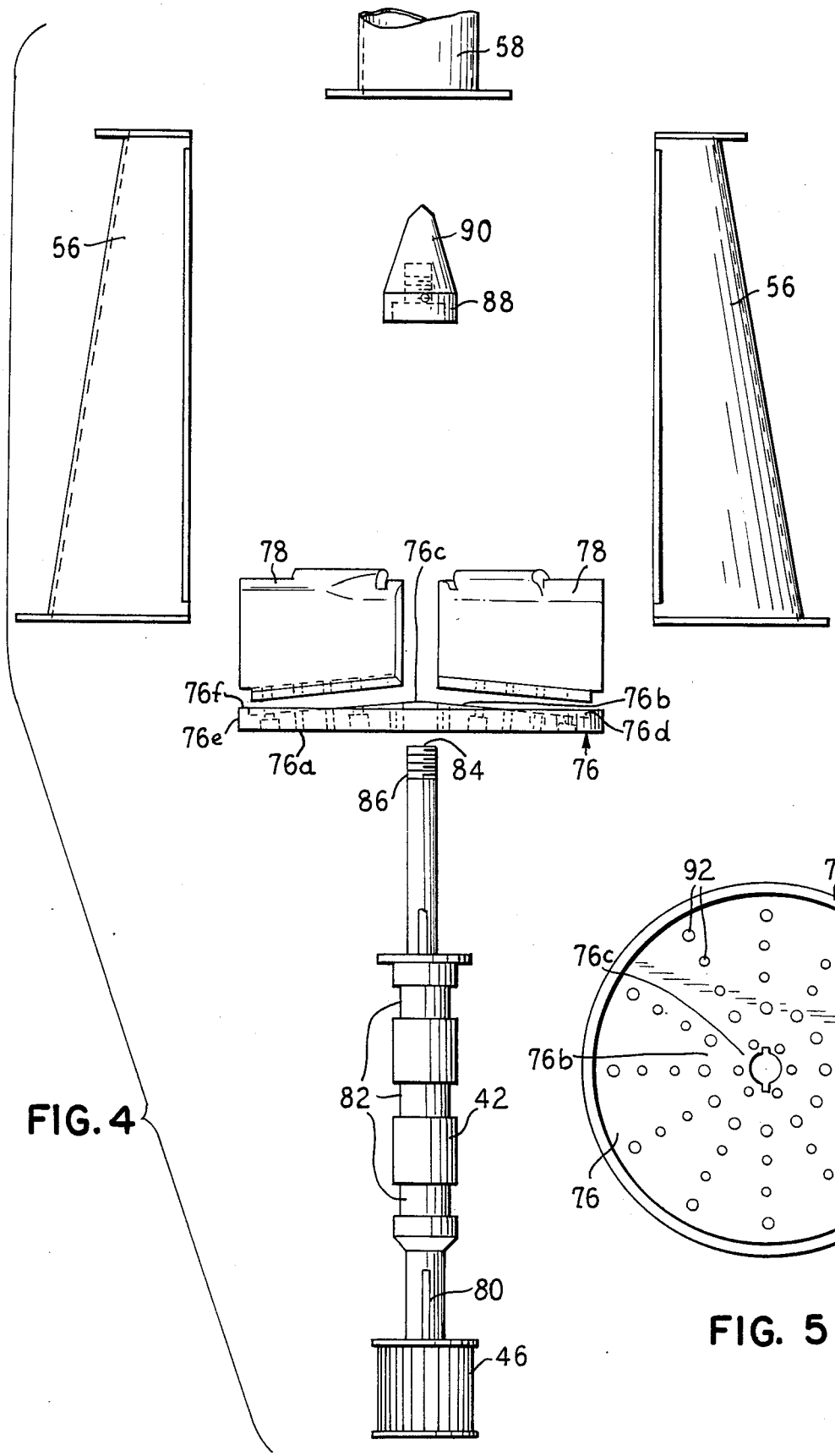
FIG. 4 is an exploded view of the turbine blade portion of the device.

In FIG. 1 there is generally shown a comminuting system at 10 which is mounted on a main mounting plate 12. The system 10 is comprised of a motor 14, a variable speed control assembly 16 and the comminuting device itself more specifically at 18. A separate mounting plate 20 is used to carry a velocity tube 22 and a material inlet feed 24.

As seen in FIG. 1 and in side view of FIG. 2, the motor 14 has an extending shaft 26 with a pulley 28 attached thereto for corotation with the shaft 26.

The variable speed assembly 16 is comprised of a jack shaft 30 journaled in bearings 32 and 34 at each end. A first pulley 36 is positioned in alignment with the pulley 28 carried on the motor shaft 26 such that a belt 38 can be attached around the pulleys to provide a driving engagement between the motor 14 and the jack shaft 30. A variable sized pulley 40 is mounted on the jack shaft 30 adjacent to the first pulley 36.

The comminuting device 18 has a shaft 42 carried in a plurality of bearings 44 and has one end carrying a pulley 46 which is alignment with the variable sized pulley 40 carried on the jack shaft 30. This permits a pulley belt 48 to be attached to the pulley 46 and the variable size pulley 40 to provide driving engagement between the jack shaft 30 and the comminuting device shaft 42. The variable size of the pulley 40 permits the user to adjust the resultant rotational speed of the comminuting device shaft 42.

The comminuting device 18 has a housing 50 with a tangential outlet opening 52 and an axial inlet opening 54 which has attached to it a frusto-conical expansion chamber 56. A velocity chamber 58 attaches at the open end of the expansion chamber 56 and connects the expansion chamber 56 to an inlet feed tube 60.

The length of the velocity chamber 58 and the inlet feed tube can be varied depending on the material being processed through the device. The harder the material being processed, the shorter the velocity chamber should be. The higher the moisture content of the material be processed, the longer the feed tube should be.

Positioned above the inlet feed tube 60 is a feed control 62. As shown in more detail in FIG. 3, the feed control 62 can comprise an auger type conveyor 63 driven by a motor 64 through a belt 66 connected to a pulley 68 secured on an auger shaft 70. The feed control member 62 can comprise a tube 72 with an opening 74 for receiving a solid granular material to be comminuted.

Figure 5:
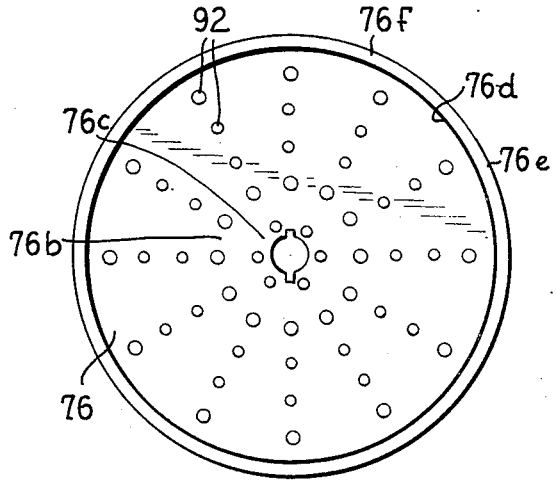
FIG. 5 is an end elevational view of the mounting plate for the turbine fan blades.

As seen in FIGS. 4–7, carried within the turbine housing 50 is a backing plate 76 which has mounted to it a plurality of turbine fan blade members 78. The backing plate 76 is shown in a plan view in FIG. 5 where it is seen that there are a plurality of mounting holes 92 for receiving bolts securing the turbine blade members 78 to the backing plate 76.

The backing plate 76 comprises a disk-like member with a substantially planar back face **76*a* and a front face 76*b* which is elevated at a central portion 76*c* and which slopes downwardly in a radially outwardly direction to a point 76*d* just short of an outer periphery 76*e* of the backing plate where an annular rim 76*f* is formed at approximately the height of the central portion 76*c*. The purpose of the annular rim is to provide a radial stop for the turbine fan blade members 78** as is described in greater detail below.

The comminutor shaft 42 has the pulley 46 attached at one end by a spline connection 80 and has a plurality of raceways 82 for receiving the mounting bearings 44. A front end 84 of the shaft 42 has a threaded free end 86 over which the backing plate 76 passes and a locking ring 88 can be threaded onto the shaft extension 84 to lock the turbine blades 78 onto the backing ring 76. Also, a nose cone 90 can be threadingly retained on the shaft extension 86 to provide a low profile deflection member for the central area of the turbine as shown, the locking ring 88 can be formed as a part of the nose cone 90.

In FIGS. 8–10, the mounting and cooling arrangement for the shaft 42 is shown in which the bearings 44 are secured to a mounting housing 94 and are supplied with lubricating oil which is maintained in a reservoir 96 in the mounting housing. A conduit 98 circulates fluid past a cooling coil area 100 which is air cooled by a motor driven fan 102. A pump 104 having a connection to the reservoir 96 provides the recirculation force for the circuit directing the cooled oil back to the bearings 44.

By providing a cooling arrangement for the bearings, the bearings are assured of a longer life and thus are subject to less wear. Further, by cooling the bearings, the shaft 42, which is greatly enlarged in diameter over the shafts disclosed in the prior art, is cooled, which causes heat to flow from the turbine blades 78 and backing plate 76, thereby increasing the life of those parts and hence the efficiency of the device.

The actual construction of the turbine fan blades 78 is shown in FIGS. 11–14. As seen in side view in FIG. 14, the turbine fan blade 78 is formed in an L-shape with a bottom leg 106 and an upstanding side leg 108. As seen in FIGS. 11 and 13, the bottom leg 106 is formed in a pie wedge shape having a first edge 110 parallel with a backside 112 of the upstanding leg 108. A second edge 114 joins at a vertex 116 with the first edge 110. There is a curved edge 118 opposite the vertex. A rabbet 120 is formed along a bottom side of the curved edge 118 which is to engage against the inner face **76*d* of the annular rim 76*f* formed on the backing plate 76**.

Both of the edges 114 and 110 of the bottom leg 106 are beveled to provide mating surfaces for adjacent turbine fan blades which will permit slight overlapping between adjacent fan blades to provide a slight axial height adjustments between the blades. A plurality of holes 122 are provided in the bottom leg 106 which are to align with the holes 92 formed in the backing plate such that threaded fasteners can be inserted through the aligned holes to retain the turbine fan blades 78 against the backing plate 76. The interaction of the rabbet 120 with the annular rim **76*f*** will provide the necessary restraint to overcome the radial forces generated by the rapid rotation of the backing plate and turbine blades.

The upstanding leg 108 has a bottom edge 124 which is angled to correspond with the angle of the front face **76*b* of the backing plate 76. A radial inside edge 126 and a radial outside edge 128 of the leg 108 are formed parallel to each other and such that they will be perpendicular to the back face 76*a* of the backing plate 76 when the turbine fan blade 78 is attached to the backing plate. A front face 130 of the upstanding leg 108 has a curved profile between the edges 126 and 128, as best seen in FIG. 13, such that the thickness of the upstanding leg 108 first increases in a direction moving away from edge 126** and then decreases to form an air foil shape.

A top edge 132 has various contours. A radial outer portion 133 of the top edge 132, adjacent the side edge 128 is formed at a right angle to the side edge 128 and is dimensioned so that it will be positioned closely adjacent to an inside front surface 134 of the housing 50 (FIG. 6) which avoids the necessity of a separate welded ring as is required by the device disclosed by Clute.

Radially inwardly, toward edge 126, the top edge projects further axially forward at 135 and this portion of the turbine blade projects beyond the front face 134 of the housing 50 into the frusto-conical expansion chamber 56. A radially outside edge 136 of the projection 135 is dimensioned to be spaced close to the wall of the frusto-conical expansion chamber 56 to provide a very small gap between the turbine fan blade 78 and the expansion chamber wall at the opening in the housing.

A notch 138 is formed in the top edge 132 near the radial inside edge 126 of the projection 135 which is to receive the retaining ring 88. This retaining ring 88 thus provides additional resistance against the radial forces caused by the spinning of the turbine blades.

A pressure sensing device 140 is mounted on the expansion chamber 56 adjacent to the housing inlet 54 to permit a monitoring of the pressure in the interior of the expansion chamber. The variable pulley 40 can be adjusted in response to the pressure reading on the sensing device 140 to compensate for fluctuations in motor speed and to vary the size of the comminuted particles.

Thus, it is seen that the present invention provides a material comminutor which has a means for varying the speed of the fan, being the variable sized pulley 40 on the jack shaft 30 which permits the user to compensate for RPM fluctuation of the turbine and to effect a change in the size of the materials which have been comminuted. Also, the frusto-connical expansion chamber is replaceable with chambers having different lengths thereby varying the rate of pressure reduction experienced by materials passing through the expansion chamber. It has been found that there is a direct relation between the rate of pressure reduction and the particle size obtained.

Further, the present invention provides a means for cooling the bearings that the communitor shaft is journaled in to provide an increased life for the bearing shaft and for reducing the temperature of the turbine fan blade members. The turbine blades themselves are configured vastly different than those of the prior art to increase the efficiency of air flow through the device and to reduce the frictional wearing effect of the material passing through the device on the turbine blades. A pressure sensing device is also utilized to permit the control of the speed of the turbine blades to effect proper sizing of the comminuted material. Thus, the device disclosed which incorporates the principles of the present invention provides a substantial improvement over prior art devices in that it is more efficient, has a longer life between replacements and repairs and provides greater control over the resultant size of comminuted materials.

The following examples of materials and configuration of the device illustrate the effectiveness of the device.

| Material Size | Length of feed opening | Length of accel tube | Feed rate tons/hour | Turbine rpm | % Mesh size Dry Screen | % Moisture | Material |
|---|---|---|---|---|---|---|---|
| ¾–3" | 4'4" | 8'6" | 11 | 2800 | 75/200 | 18% | So. Ill. coal |
| ¾–3" | 4'4" | 8'6" | 14 | 3000 | 80/225 | 18% | So. Ill. coal |
| ¾–3" | 4'4" | 6'6" | 11 | 3200 | 60/250 | 28% | So. Ill. coal |
| ¾–3" | 4'4" | 6'6" | 15 | 3450 | 80/325 | 14% | So. Ill. coal |
| ½" | 4'0" | 8'6" | 10 | 3000 | 50/125 | 14% | Iowa limestone |
| ½" | 4'0" | 6'6" | 10 | 3450 | 60/200 | 14% | Iowa limestone |
| ½" | 4'0" | 6'6" | 10 | 3450 | 60/250 | 8% | Iowa limestone |
| ¾–3" | 4'4" | 8'6" | 18 | 3000 | 80/200 | — | Glass Broken Bottles |
| ¾–3" | 4'4" | 8'6" | 19 | 3450 | 80/250 | — | Glass Broken Bottles |
| ¾–3" | 4'0" | 6'6" | 18 | 3450 | 85/275 | — | Glass Broken Bottles |

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

We claim as our invention:

1. A device for the comminution of solid material comprising:

(a) a turbine comprising a plurality of blades mounted on a shaft for rotation about an axis, said shaft mounted in cantilevered manner in a set of bearings;

(b) a motor;

(c) a drive connection between said motor and said turbine for rotatably driving said turbine;

(d) a housing enclosing said turbine having an axial inlet and a tangential outlet for the passage of an air stream caused by said rotating turbine;

(e) means for varying the comminution effect of said device upon said material comprising an expansion chamber connected at one end to the axial inlet of said housing and connected at another end to a varied size velocity chamber; and (f) feed tube means for feeding material to be comminuted into said air stream upstream of said velocity chamber;

whereby, material carried in said air stream is subjected to a rapid decrease in pressure in said expansion chamber as said material is drawn through said expansion chamber, said decrease in pressure being adjustable by interchanging various sized velocity chambers to vary the size of resultant comminuted material, and said material is comminuted and is exhausted with said air stream through said housing outlet.

2. A device for the comminution of solid material comprising:

(a) a turbine comprising a plurality of blades mounted on a shaft for rotation about an axis, said shaft mounted in cantilevered manner in a set of bearings;

(b) a motor;

(c) a drive connection between said motor and said turbine for rotatably driving said turbine;

(d) a housing enclosing said turbine having an axial and a tangential outlet for the passage of an air stream caused by said rotating turbine;

(e) means for varying the comminution effect of said device upon said material comprising a varied size expansion chamber connected at one end to the axial inlet of said housing and connected at another end to a velocity chamber; and (f) feed tube means for feeding material to be comminuted into said air stream upstream of said velocity chamber;

whereby, material carried in said air stream is subjected to a rapid decrease in pressure in said extension chamber as said material is drawn through said expansion chamber, said decrease in pressure being adjustable by interchanging various sized expansion chambers to vary the size of resultant comminuted material, and said material is comminuted and is exhausted with said air stream through said housing outlet.

* * * * *